United States Patent [19]

Addleman

[11] Patent Number: 4,674,944

[45] Date of Patent: Jun. 23, 1987

[54] FORKLIFT VARIABLE REACH MECHANISM

[75] Inventor: Jeffrey L. Addleman, Chambersburg, Pa.

[73] Assignee: Kidde, Inc., Saddle Brook, N.J.

[21] Appl. No.: 813,852

[22] Filed: Dec. 27, 1985

[51] Int. Cl.[4] ..... B66C 23/04; B66C 23/14

[52] U.S. Cl. ..... 414/708; 414/718; 414/917; 414/706

[58] Field of Search ..... 414/706, 708, 718, 697, 414/733, 917; 212/267

[56] References Cited

U.S. PATENT DOCUMENTS

| | | | |
|---|---|---|---|
| 3,001,654 | 9/1961 | Albert | 414/685 X |
| 3,230,717 | 1/1966 | Alden | 414/708 X |
| 3,288,316 | 11/1966 | West | 414/708 |
| 3,606,060 | 9/1971 | Fleming et al. | 414/708 |
| 3,666,122 | 5/1972 | Youmans | 414/917 X |
| 3,840,128 | 10/1974 | Swoboda, Jr. et al. | 414/708 X |
| 4,042,135 | 8/1977 | Pugh et al. | 414/718 |
| 4,249,854 | 2/1981 | Teti | 414/685 |
| 4,365,926 | 12/1982 | Brown | 414/685 |
| 4,583,907 | 4/1986 | Wimberly | 414/706 X |

FOREIGN PATENT DOCUMENTS

| | | | |
|---|---|---|---|
| 762289 | 7/1967 | Canada | 414/708 |

*Primary Examiner*—L. J. Paperner
*Assistant Examiner*—Jay I. Alexander
*Attorney, Agent, or Firm*—Brady, O'Boyle & Gates

[57] ABSTRACT

A mechanism for use on a boom-type vehicle includes load lifting forks carried by a low profile twist-resistant carriage which is one link in a low profile parallelogram linkage attached to a fly section of the boom and maintained level in all positions of the boom by a slave cylinder connected between the boom and a slave link which constitutes a member of the parallelogram linkage. The mechanism can be adjusted to many positions while automatically maintaining the relative position of the forks with respect to the vehicle frame for any boom angle. The mechanism can be adjusted to provide a long reach over or under obstructions in order to remove or place a load. It may also engage loads below ground level. Load pick-up or placement can be performed in confined areas which are unreachable by conventional forklift trucks.

10 Claims, 11 Drawing Figures

FORKLIFT VARIABLE REACH MECHANISM

BACKGROUND OF THE INVENTION

Prior U.S. Pat. No. 4,365,926 discloses broadly a forklift assembly attached to an extensible and retractable boom. U.S. Pat. Nos. 3,001,654 and 3,288,316 disclose self-leveling forklift assemblies. U.S. Pat. No. 3,288,316 additionally discloses a master cylinder which responds to luffing of the boom to operate a slave cylinder connected between the boom and the forklift assembly to control the angular position of the latter.

The present invention has for its main objective to improve on the known prior art in a major way by providing a forklift variable reach mechanism for boom-type vehicles in which a self-leveling low profile twist-resistant forklift assembly and carriage is connected with the boom of the machine through a low profile parallelogram linkage, whereby the vertical height of the entire mechanism, when extended longitudinally of the boom, is approximately no greater than the depth or height of the boom base section.

A further object and feature of the invention is to provide a self-leveling low profile essentially self-contained forklift carriage unit which can be moved by a power cylinder of the low profile parallelogram linkage through a wide rotational range on the boom of the machine between elevated horizontal load-engaging positions and depressed positions including a position somewhat below ground level, when the boom is at a depressed angle below the horizontal. The mechanism can also assume a working position longitudinally coaxially with the boom to enable reaching into vertically confined spaces as small as eighteen inches in height.

Another important object of the invention resides in the provision of a variable reach forklift assembly in which the lifting forks are adjustably held on a very low profile twist-resistant carriage structure having a built-in torque tube and containing a pair of opposing power cylinders for adjusting the lifting forks or tines laterally, the two adjusting cylinders lying in a common plane close to the plane occupied by the forks and parallel thereto. The two cylinders are also in parallel relationship with the built-in torque or torsion tube, and lie substantially in a common plane therewith.

Other objects and advantages of the present invention will become apparent to those skilled in the art during the course of the following description.

DETAILED DESCRIPTION

Figure 1:
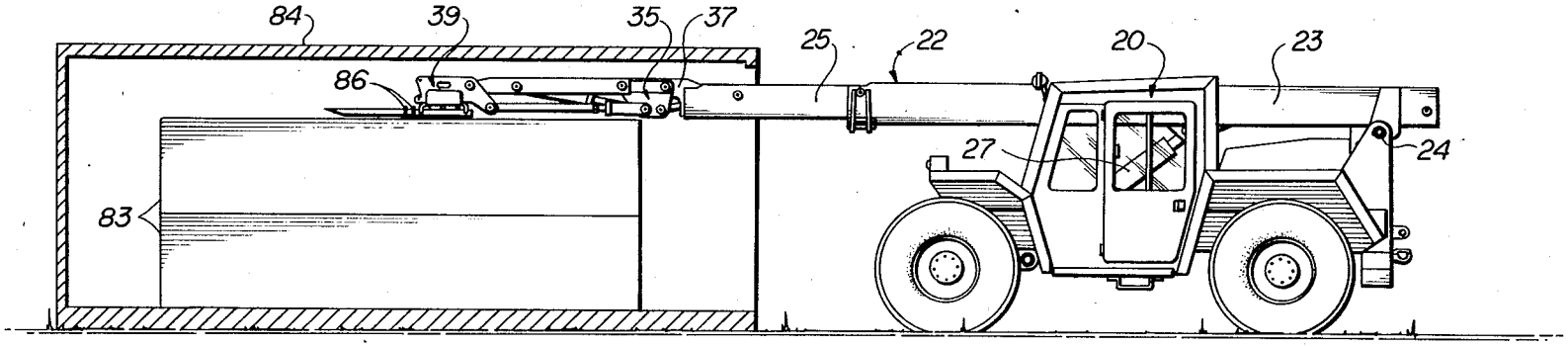
FIG. 1 is a side elevation of a forklift variable reach mechanism according to the present invention, showing one use mode thereof.

Referring to the drawings in detail, wherein like numerals designate like parts, a forklift variable reach machine according to the present invention comprises a self-propelled steerable vehicle 20 having a rigid frame 21 and being equipped with conventional hydraulic controls operated by the driver of the vehicle. The conventional hydraulic controls form no part of the invention and therefore are not illustrated.

An extensible and retractable telescoping boom 22 includes a base section 23 attached by a pivot means 24 to the vehicle frame 21. The boom also includes a fly section 25 operatively connected with the base section 23 by an internal conventional hydraulic cylinder 26.

A luffing cylinder 27 is connected between the lower side of the boom base section 23 by a pivotal connection 28 and a point on the lower forward portion of the vehicle 20 defined by another connection 29. The luffing cylinder 27 by means of which the boom 22 is raised and lowered on the pivot means 24 is inclined rearwardly and upwardly, as shown. Typically, the boom 22 can be elevated to a maximum angle of about 47° above the horizontal and can also be depressed to a negative angle of approximately 7° below the horizontal. While a two section boom 22 is shown in the application, a telescoping boom having three or more sections could also be used. Also, if desired, the entire boom structure could be installed on a turntable mounted on the vehicle to even further improve the versatility of the device.

Figure 2:
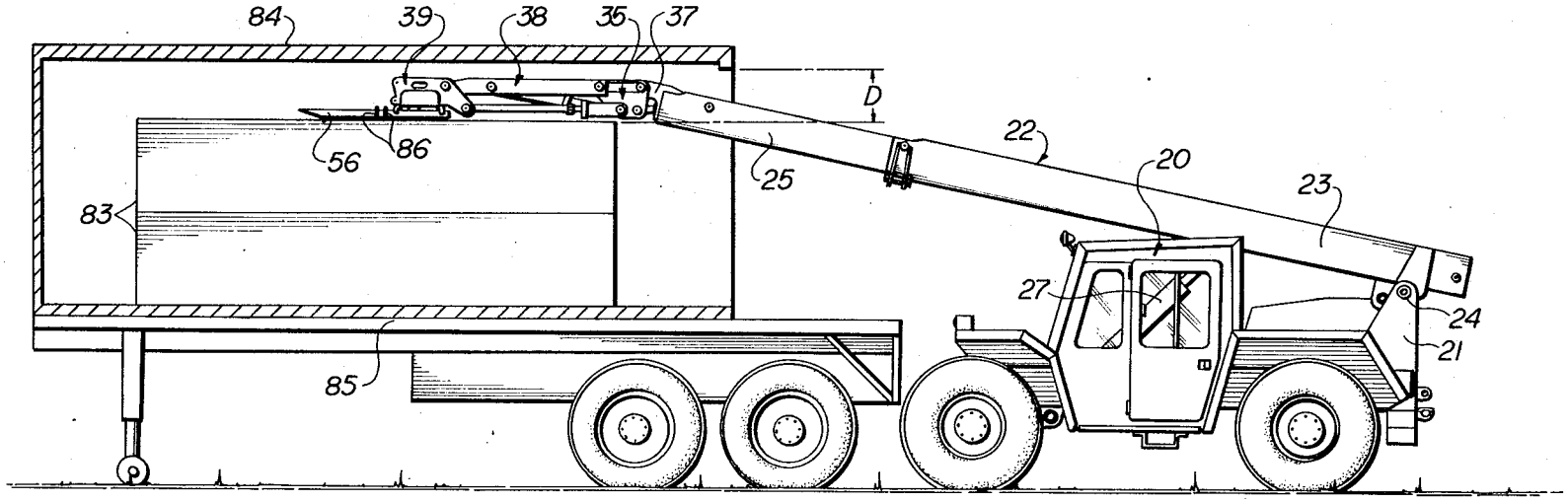
FIG. 2 is a similar view of the invention showing a different use mode thereof.
Figure 3:
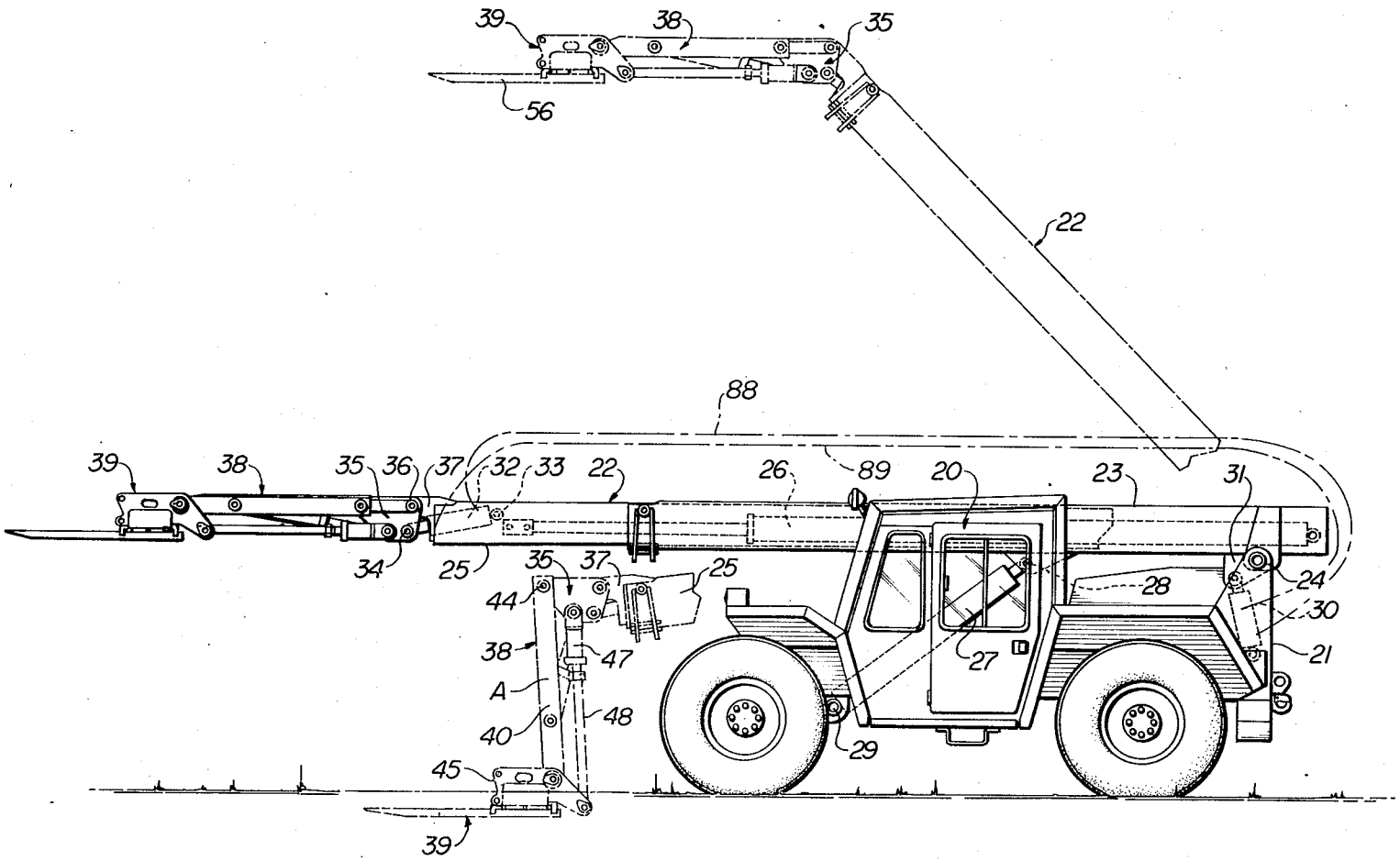
FIG. 3 is a further side elevation of the forklift variable reach mechanism depicting a range of movements of the self-leveling forklift assembly.
Figure 4:
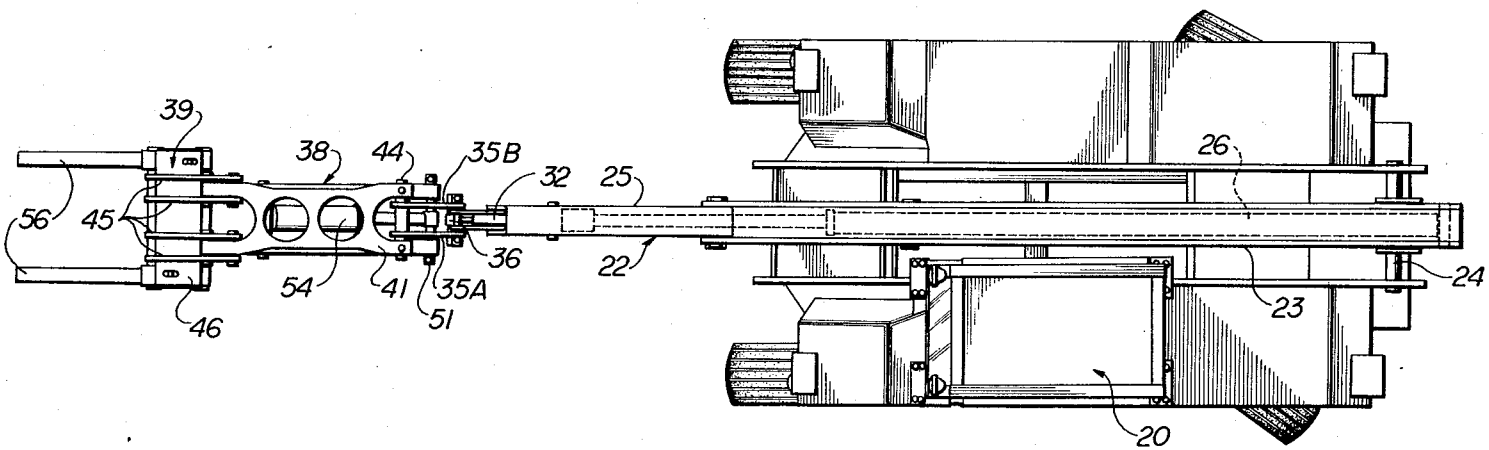
FIG. 4 is a plan view of the invention.

A master hydraulic cylinder 30, FIG. 3, is connected between the fixed frame 21 of the vehicle and a bracket 31 on the lower side of the base section 23 adjacent to the pivot 24 for the boom. A coacting slave cylinder 32 is pivotally connected at 33 to the fly section 25 near its forward end and also connected by a pivot connection 34 to a slave link 35 having a main pivotal connection at 36 with a pair of spaced parallel mounting plates 37 which are slightly offset upwardly from the top side of the boom fly section 25 to provide a better reach of the mechanism into a shallow space of as little as eighteen inches, indicated by the distance D in FIG. 2.

The master cylinder 30 is extended and retracted automatically by the raising and lowering of the boom 22. Through conventional fluid connections 88 and 89 in FIG. 3, between the master cylinder 30 and slave cylinder 32, the slave cylinder responds automatically to the movements of the master cylinder and maintains the pivoted slave link 35 level in all angularly adjusted positions of the boom 22.

Figure 5:
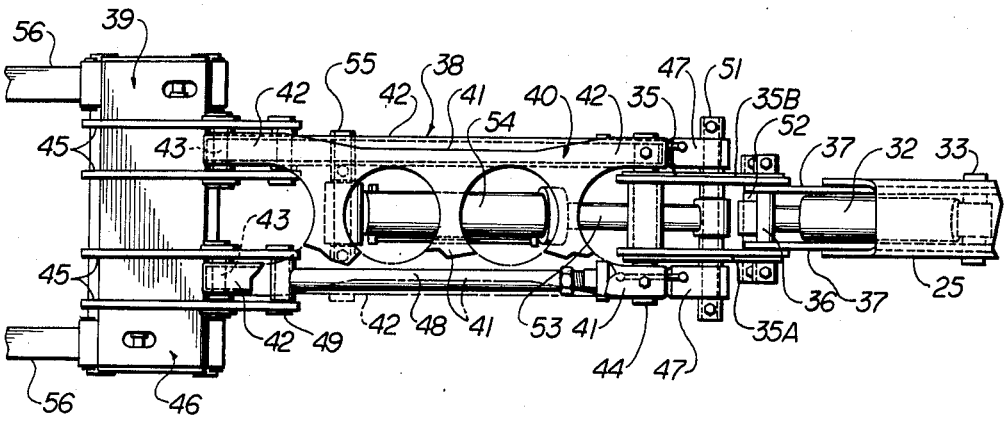
FIG. 5 is an enlarged fragmentary plan view of the mechanism including the low profile parallelogram linkage connected between the forklift assembly and the boom.

The slave link 35 consists of two spaced side-by-side link plates **35*a* and 35*b*, FIG. 5, the pivotal connection 36 consisting of a pivot pin engaging through apertures of the mounting plates 37 and the two slave link plates 35*a* and 35*b*. The mounting plates 37 are fixed to the boom fly section 25** by welding.

The slave link composed of the link plates **35*a* and 35*b* form one member of a low profile parallelogram linkage 38, which forms a very important part of the present invention. This parallelogram linkage extends between the nose of the boom fly section 25 and a low profile forklift assembly 39** which comprises another important part and feature of the invention, to be described in detail.

The low profile parallelogram linkage 38 further includes a top longitudinal link 40 consisting of a top plate 41 united at its opposite ends with laterally spaced tubular extensions 42 which are connected by transverse pivot pins 43 and a single pivot pin 44, respectively, with parallel vertical plates 45 and the aforementioned slave link plates 35*a* and 35*b*.

A carriage structure 46 of the forklift assembly 39 serves as the front transverse link of the parallelogram linkage 38. The lower longitudinal link of the parallelogram linkage is composed of two parallel short stroke hydraulic cylinders 47 having rods 48, connected by pivot elements 49 with rear inclined extensions 50 of the spaced vertical plates 45 which are fixed as by welding to the top of the carriage structure 46. The short stroke cylinders 47 are connected by a transverse pivot pin 51 to the slave link plates 35*a* and 35*b* near and forwardly of their pivotal connection with the slave cylinder 32 by another transverse pivot element 52.

The pivot pin 51 also serves to connect the rod 53 of a somewhat inclined power cylinder 54 with the slave link plates 35*a* and 35*b*. The body of cylinder 54 is connected by a transverse pivot element 55 with the top link 40 of the parallelogram linkage 38. The cylinder 54 lies within the space encompassed by the low profile parallelogram linkage and its purpose is to rotate the linkage 38 upwardly and downwardly on the slave link 35, which always remains level, as explained. The linkage rotating cylinder 54 rotates parallelogram linkage 38 on the axes of the two parallel pivot elements 44 and 51 at required times so that the mechanism can assume positions such as those indicated by phantom lines at A, FIG. 3, and B and C, FIG. 6, as well as intermediate positions. The cylinder 54 is not automatic in its operation but is controlled by conventional control means provided in the cab of the vehicle 20.

The cylinders 47, in addition to forming the lower longitudinal link of the parallelogram linkage 38, also function under the influence of conventional driver controls to rock the entire forklift assembly 39 on the axis of pivot pins 43 to thereby tilt the forklift carriage structure 46 and two forks or tines 56 carried thereby.

This feature provides an additional controlled movement for the mechanism which is automatically self-leveling under influence of the slave cylinder 32 and associated elements, as described.

The forklift assembly 39 which includes the carriage structure 46 and the two forks 56 is constructed as follows. The carriage structure 46 comprises an inverted channel body 57 having end walls 58 and side walls 59. An interior wall 60 spaced somewhat from one side wall 59 reinforces the channel body 57 and forms along the forward side thereof a built-in torque or torsion tube which resists twisting of the carriage structure 46 caused by uneven loading of the forks 56. The bottom of this torque tube is closed by a forward transverse horizontal rail 61 which extends for the entire width of the forklift carriage structure and is welded to the latter. A rear transverse horizontal rail 62 is similarly provided on the bottom of the channel body 57 along its rear side.

The two forks 56 are hung on the rails 61 and 62 by L-shaped hanger brackets 63 and 64 having short legs 65 which straddle the forks and are welded thereto. The hanger brackets 63 have wear pads 66 attached to their lower faces and these wear pads ride on the top face of the forward rail 61 as the forks 56 are adjusted laterally. Wear pads 67 are secured to the top faces of the forks near their rear ends and ride on the bottom faces of the rear rail 62.

Figure 7:
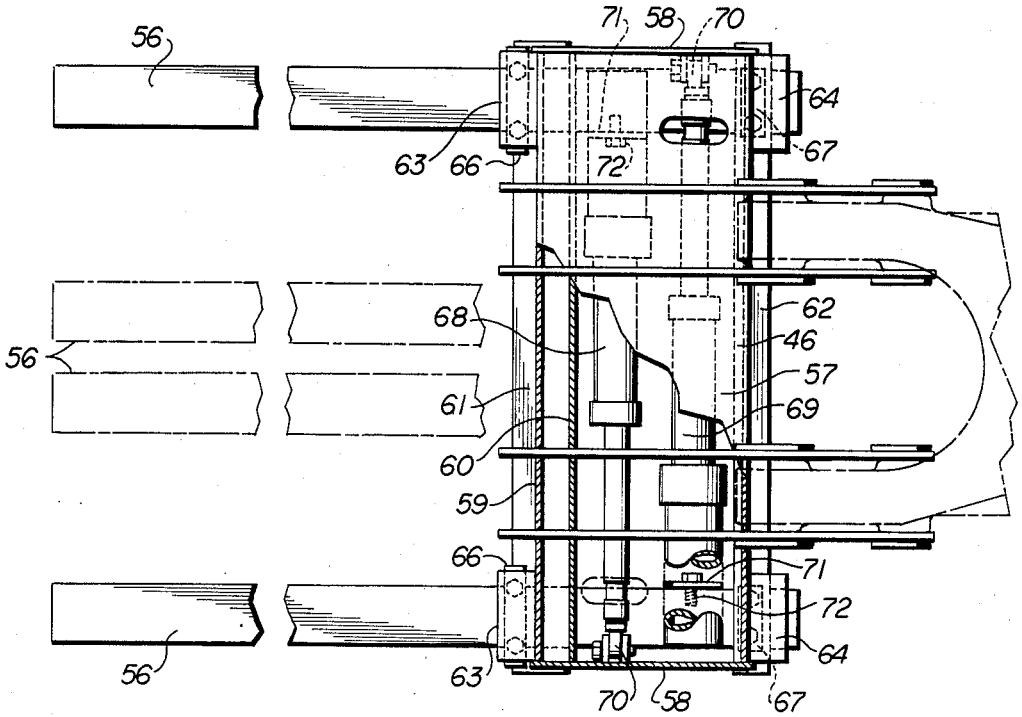
FIG. 7 is a plan view, partly in section and partly broken away, of the forklift assembly.

For adjusting the forks or tines 56 laterally on the carriage structure 46, a pair of side-by-side parallel opposing power cylinders 68 and 69 are arranged inside of the channel body 57 near the elevation of the forks 56 and the built-in torque or torsion tube which includes the wall 60. The rods of these two opposing cylinders are coupled as shown at 70, FIG. 7, to the two end walls 58. The bodies of the two cylinders have welded thereto vertical cradle plates 71 which support the cylinder bodies and are bolted to the interior longitudinal edges of the forks 56 by bolts 72 or screws. When these bolts are removed, the forks 56 can be separated from the carriage structure 46 by sliding off of the ends of the rails 61 and 62.

Figure 8A:
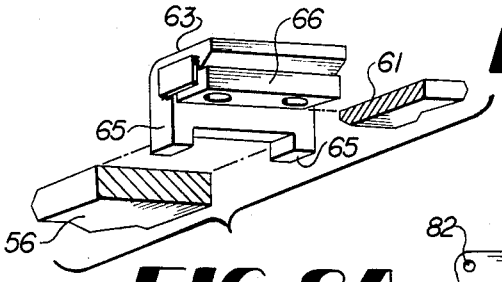
FIG. 8A is a fragmentary exploded perspective view of elements of the forklift assembly shown in FIGS. 7 and 8.
Figure 8:
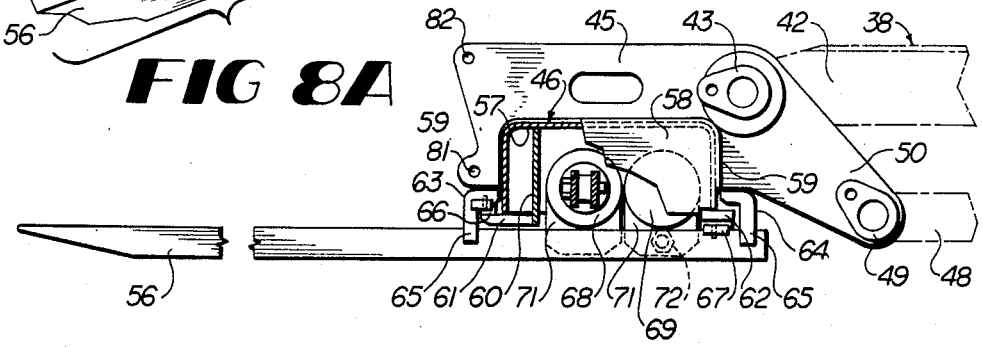
FIG. 8 is a side elevation thereof, partly in cross-section.
Figure 10:
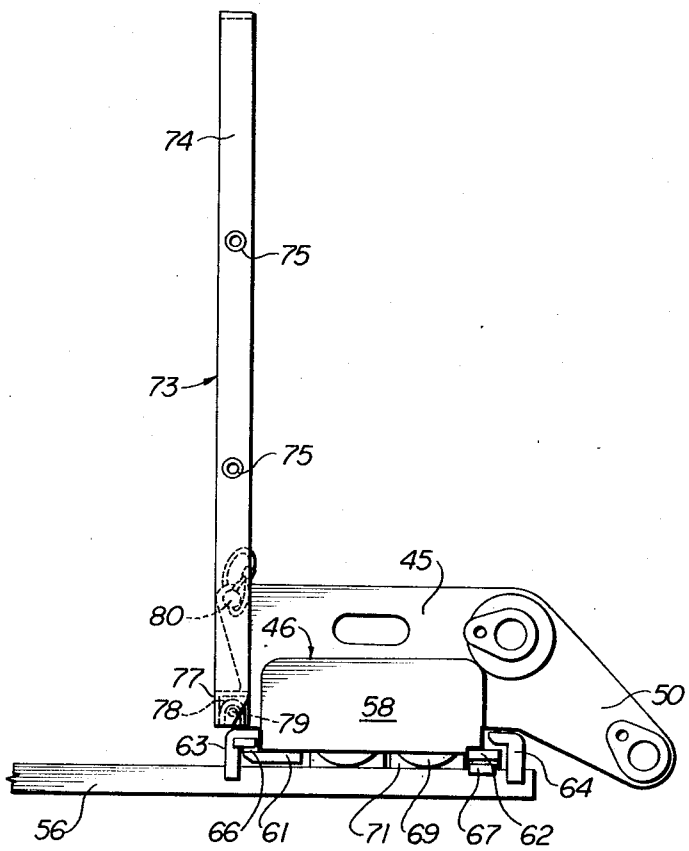
FIG. 10 is a side elevation thereof.
Figure 9:
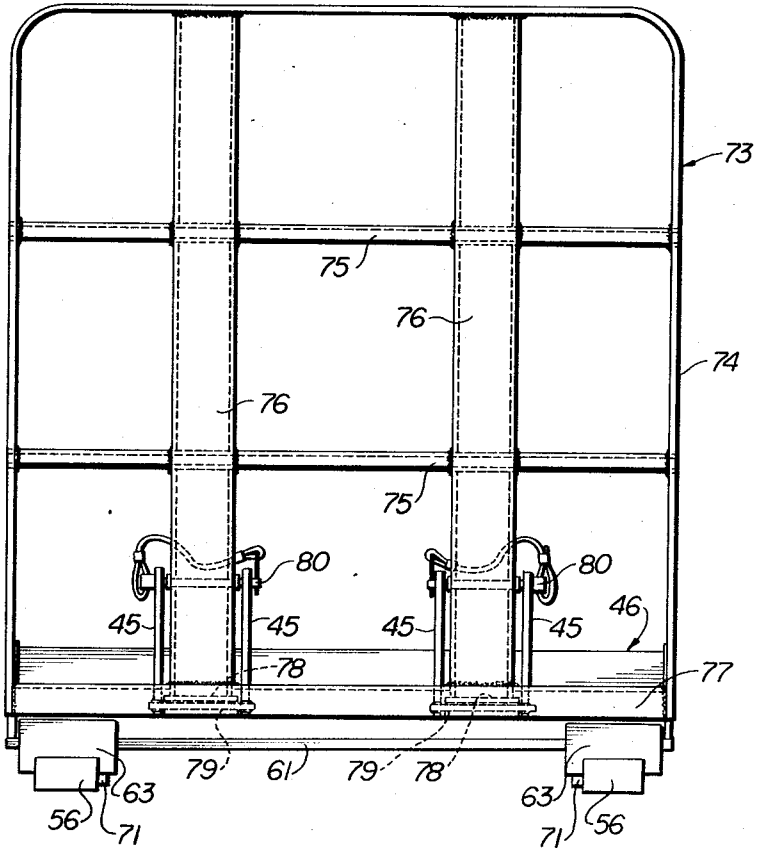
FIG. 9 is a front elevation of a backrest attachment for the forklift assembly.

FIGS. 9 and 10 of the drawings depict a backrest attachment 73 for the forklift assembly 39 to protect cargo and personnel in cases where the forks 56 are tilted upwardly and the load on them has a tendency to ride rearwardly. The backrest attachment comprises a generally rectangular frame 74 having horizontal reinforcing bars 75 connected between its sides and sturdy vertical members 76 connected between its top and bottom members. The bottom member 77 of the frame 74 contains inverted U-shaped elements 78 fixed therein and straddling pins 79 held in the pairs of vertical plates 45 near their bottoms. Tethered locking pins 80 engage removably through apertures in the plates 45 and members 76 to releasably secure the attachment 73 in its use position. The apertures 81 and 82 for the respective pins 79 and 80 formed through the plates 45 may be seen in FIG. 8 of the drawings.

In view of the foregoing detailed description, the mode of operation and use of the machine is somewhat self-evident. FIGS. 1 and 2 illustrate the use of the low profile forklift mechanism for reaching, engaging and removing cargo units 83 from a container 84 which may be resting on the ground, FIG. 1, or on a truck bed 85, FIG. 2. In either case, the access space D between the roof of the container 84 and the topmost cargo unit 83 may be as shallow as eighteen inches, as previously explained. The low profile forklift mechanism including the parallelogram linkage 38 and forklift assembly 39 can enter this shallow space in either situation, FIGS. 1 or 2, by adjusting the boom 22 to a level state or to an elevated position, as shown in the two figures, and extending the boom fly section 25 the necessary distance. The slave link 35 and the entire forklift assembly 39 will always remain level, regardless of the angle of the boom 22 relative to the horizontal. The forks or tines 56 can be engaged with lifting elements 86 on the cargo units 83 to enable lifting and removal of these units by the machine from the container 84. The boom 22, in some cases, can be depressed to a slight negative angle below the horizontal position shown in FIG. 1.

The lifting forks 56 are adjusted inwardly and outwardly laterally by the two power cylinders 68 and 69 which are remotely controlled from the vehicle cab, to meet the necessary requirements for proper engagement with the cargo. The power cylinder 54 is operated at proper times to swing or rotate the parallelogram linkage 38 on the pivots 44 and 51, the slave link 35 and the forklift assembly 39 remaining level at all times due to the automatic action of the slave cylinder 32. The arrangement enables the engagement and lifting of cargo at many positions including below ground level or at high elevations, as shown in FIG. 3 and at intermediate elevations, FIG. 6. The short stroke cylinders 47 can be utilized at any time to tilt the forklift assembly 39 relative to the linkage 38.

Figure 6:
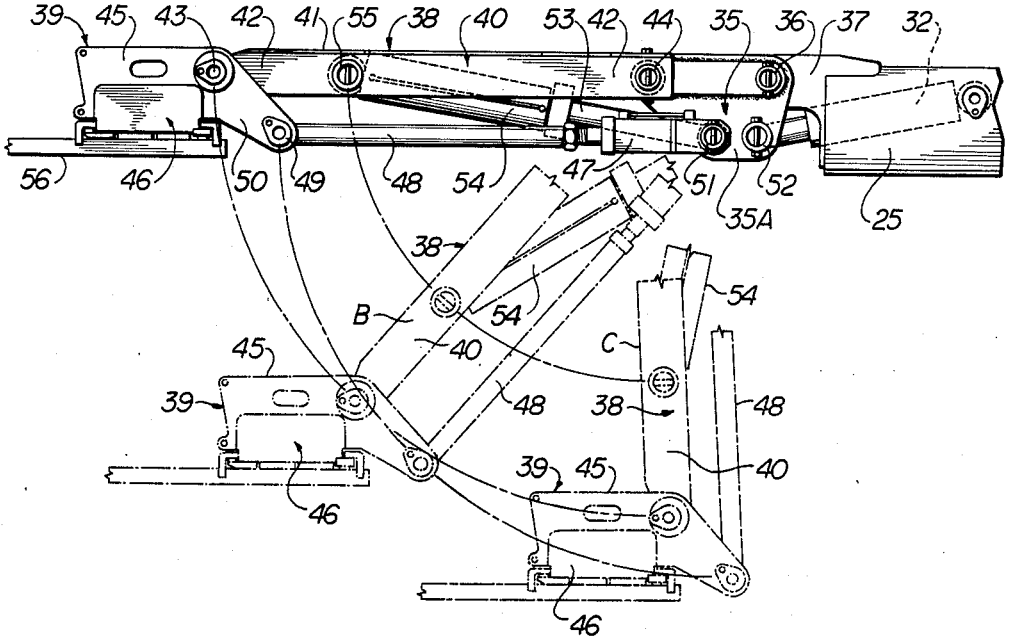
FIG. 6 is a side elevation of the same showing several adjusted positions of the mechanism.

The parallelogram linkage 38 assumes its lowest or narrowest profile when horizontally extended, FIGS. 3 and 6, or when in the full down position shown at A in FIG. 3 and at C in FIG. 6. In intermediate inclined positions, such as at B in FIG. 6, the parallelogram linkage 38 is slightly expanded because its end links composed of the elements 46 and 35 are more nearly perpendicular to the top and bottom longitudinal links.

It can now be seen that the vertical height of the mechanism composed of the parallelogram linkage 38 and the forklift assembly 39, when extended longitudinally of the boom axis, FIGS. 1 and 3, is no greater than the vertical depth or height of the boom base section 23.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A forklift variable reach machine comprising a vehicle mounted extensible and retractable boom having a base section, and adapted to be raised and lowered on a pivot connection between the boom and vehicle, a low profile parallelogram linkage carried by the leading end of the boom and including a slave link having a pivotal connection with the boom, means interconnecting the slave link and boom and being operable to hold the slave link level in all angularly adjusted positions of the boom, a low profile forklift assembly on the leading end of said parallelogram linkage and including one link of the parallelogram linkage operable to maintain the low profile forklift assembly level, and a power means connected with the parallelogram linkage to swing the linkage and the forklift assembly vertically on an arcuate path relative to said slave link.

2. A forklift variable reach machine as defined in claim 1, and said means interconnecting the slave link and boom including a slave cylinder connected between the slave link and boom and being operable to turn the slave link on its pivotal connection with the boom automatically in response to raising and lowering of the boom on its pivot connection with the vehicle.

3. A forklift variable reach machine as defined in claim 1, and said power means comprising a remotely controlled power cylinder connected between the slave link and a longitudinal link of the parallelogram linkage.

4. A forklift variable reach machine as defined in claim 1, and another power means forming one longitudinal link of the parallelogram linkage and being remotely controlled and being operable to tilt the low profile forklift assembly vertically on the parallelogram linkage.

5. A forklift variable reach machine as defined in claim 2, and said boom comprising a telescoping boom having at least a base section and a fly section, a luffing cylinder for the boom connected between the boom and the vehicle on which the boom is mounted, a master cylinder connected between the base section of the boom and said vehicle, and said slave cylinder being controlled in its operation by the operation of the master cylinder.

6. A variable reach lift mechanism comprising an extensible and retractable boom having a fly section, and adapted to be raised and lowered vertically in an arc, a low profile parallelogram linkage including a rear slave link pivotally connected to the leading end of the boom, a pair of longitudinal links having rear ends pivotally connected with the slave link and a forward comparatively short link pivotally connected with forward ends of the longitudinal links, a low profile cargo-engaging and lifting assembly carried by the forward comparatively short link, and an extensible and retractable lower device connected between the slave link and the fly section of said boom and being operable to hold the slave link level in all angularly adjusted positions of the boom.

7. A variable reach lift mechanism as defined in claim 6, and a remotely controlled power device connected between said slave link and one longitudinal link of the parallelogram linkage and being operable to swing the linkage in an arcuate vertical path around pivotal connections of the longitudinal links with said slave link, whereby the low profile cargo-engaging and lifting assembly can assume a substantially depressed position below the elevation of the boom.

8. A variable reach lift mechanism as defined in claim 7, and the other longitudinal link of the parallelogram linkage including a remotely controlled power means operable to extend or retract the other longitudinal link to cause tilting of said cargo-engaging and lifting assembly in a vertical plane on the low profile parallelogram linkage.

9. A variable reach lift mechanism as defined in claim 6, and said slave link having a main pivotal connection near its top and rear end with a plate extension on the leading end of said boom, said extensible and retractable power device comprising a slave cylinder connected between the boom and the slave link near the bottom and rear end of the slave link and below said main pivotal connection and the rear ends of the longitudinal links having pivotal connections with the slave link near its top and bottom and forward end and forwardly of the main pivotal connection and the pivotal connection of the slave cylinder with the slave link.

10. A forklift variable reach machine as defined in claim 1, and the height of the low profile parallelogram linkage and low profile forklift assembly when disposed longitudinally of each other and longitudinally of the boom axis being no greater than approximately the depth of the base section of the boom measured across the axis of the boom.

* * * * *